United States Patent [19]

Okumoto

[11] Patent Number: 4,630,399

[45] Date of Patent: Dec. 23, 1986

[54] SECURITY CLIP FOR A LOUVER PANEL

[76] Inventor: Gordon Okumoto, 1849 Vancouver Pl., Honolulu, Hi. 96822

[21] Appl. No.: 767,421

[22] Filed: Aug. 20, 1985

[51] Int. Cl.[4] ..... E06B 7/08

[52] U.S. Cl. ..... 49/403; 49/74

[58] Field of Search ..... 49/403, 74

[56] References Cited

U.S. PATENT DOCUMENTS

| | | | |
|---|---|---|---|
| 3,903,649 | 9/1975 | Dalia | 49/403 |
| 4,195,443 | 4/1980 | Driscoll | 49/403 |
| 4,195,444 | 4/1980 | Cote | 49/403 |
| 4,270,313 | 6/1981 | Dalia | 49/403 |

*Primary Examiner*—Kenneth Downey

*Attorney, Agent, or Firm*—Bacon & Thomas

[57] ABSTRACT

A security clip is disclosed for use in a louver panel which prevents removal of the louver panel from its mounting brackets. The security clip extends substantially around the entire periphery of the louver panel and is substantially contained between the louver panel and the mounting bracket. A tab extending from the security clip engages a notch in the mounting bracket such that removal of the louver panel is positively prevented even if the mounting bracket is deformed. The ends of the security clip are positively locked to prevent deformation of the security clip.

16 Claims, 10 Drawing Figures

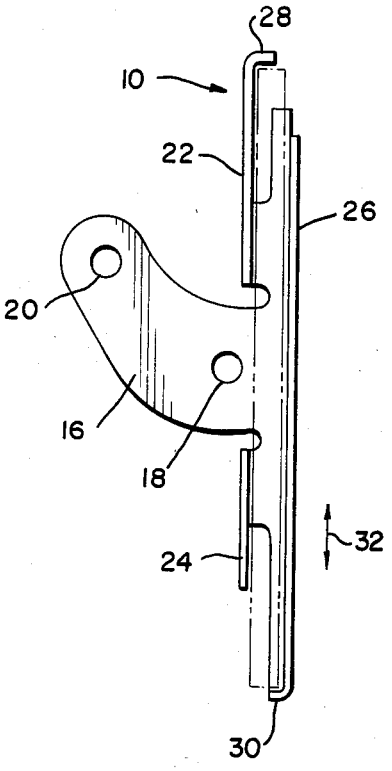
FIG. 1
PRIOR ART
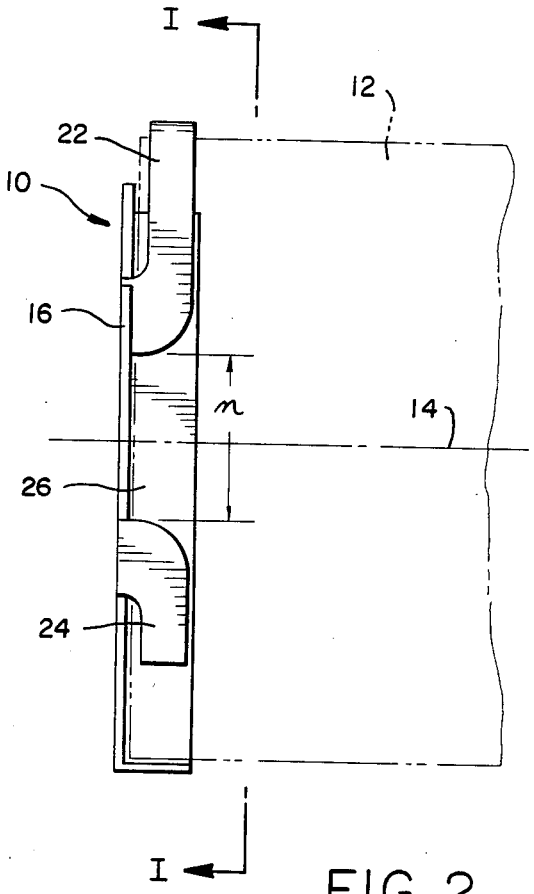
FIG. 2
PRIOR ART
FIG. 3
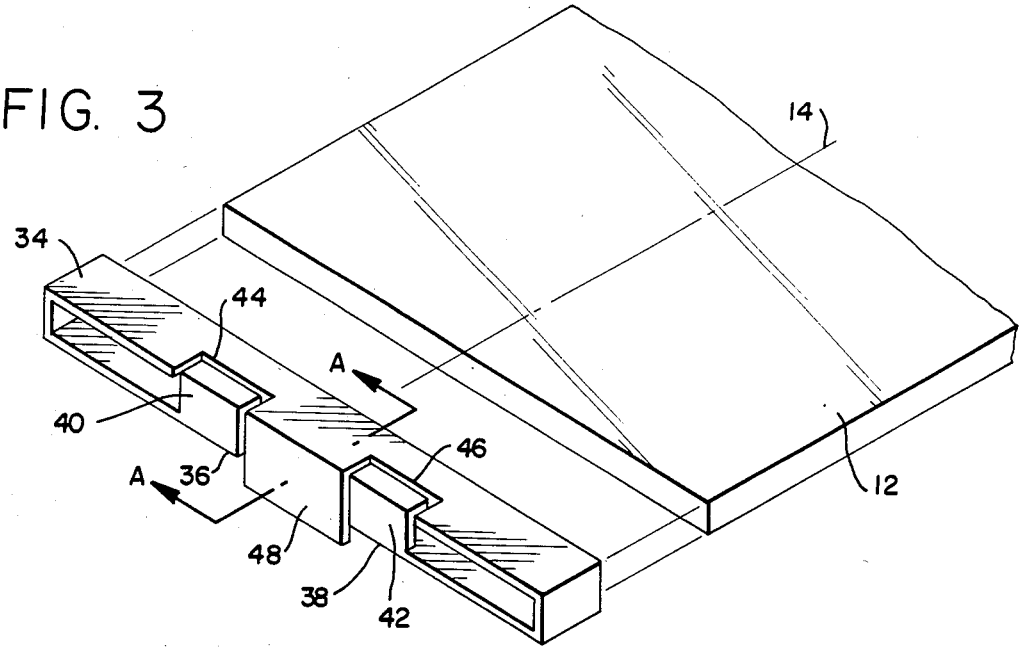

FIG. 4
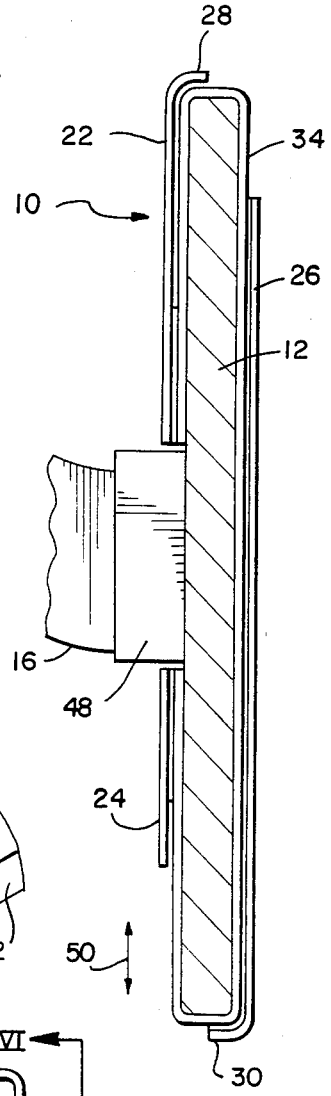
FIG. 5
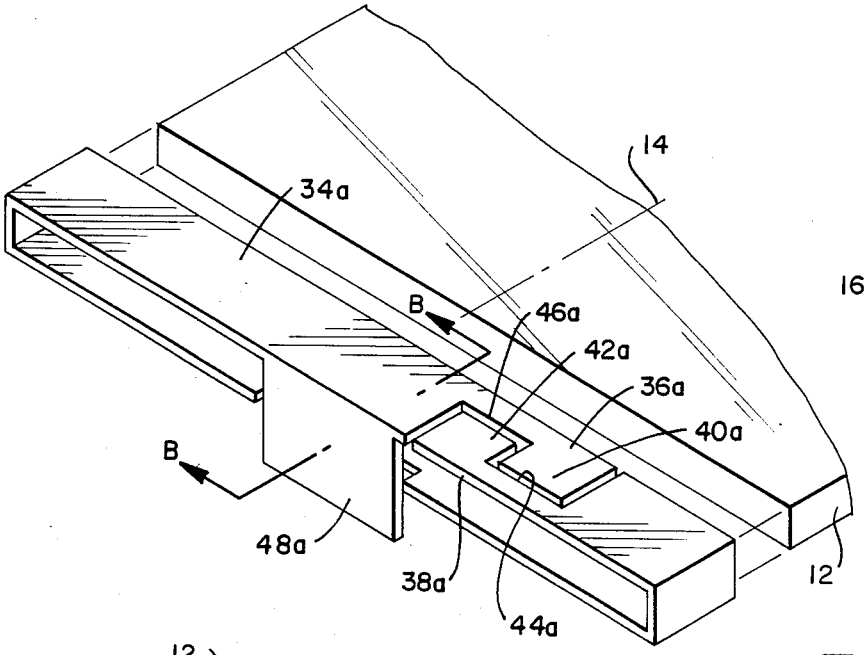
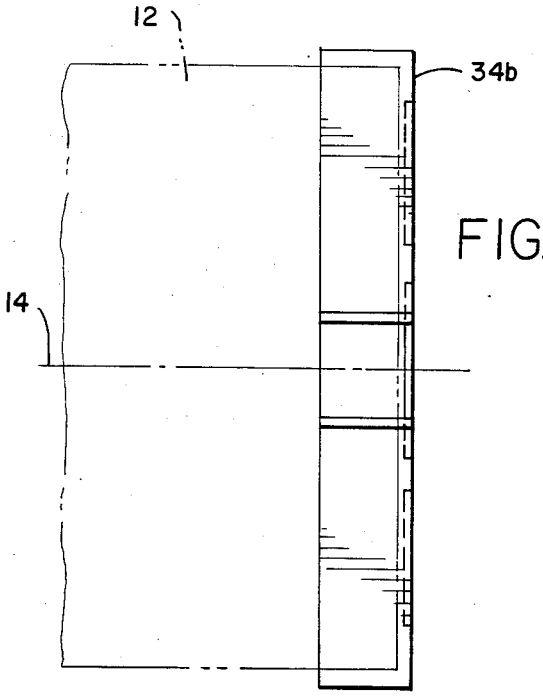
FIG. 6
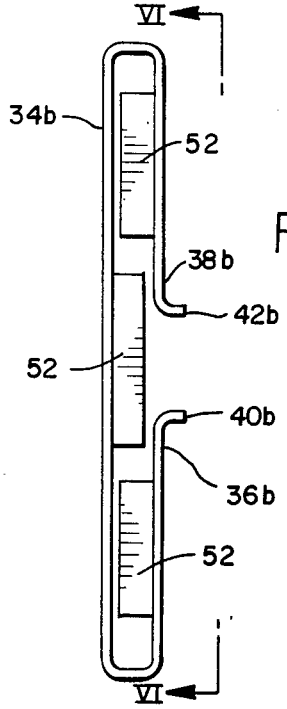
FIG. 7

FIG. 8
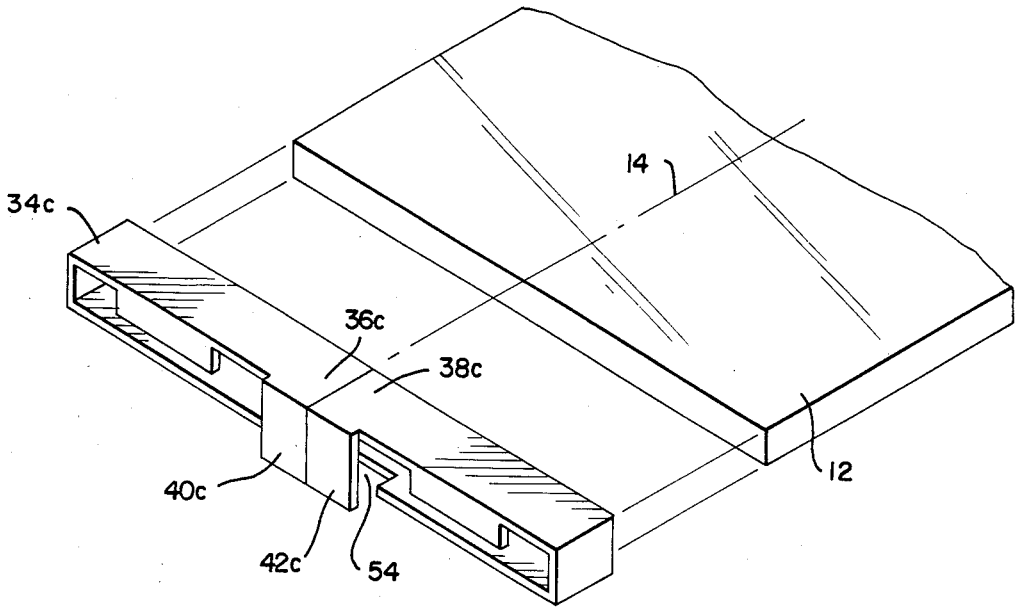
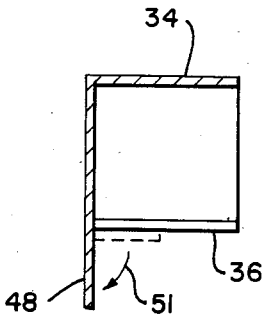
FIG. 9
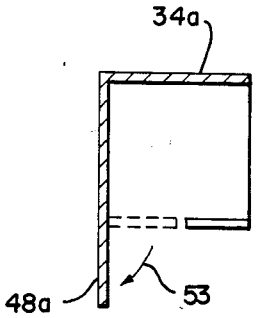
FIG. 10

SECURITY CLIP FOR A LOUVER PANEL

FIELD OF THE INVENTION

The present invention relates to a louver panel assembly, more particularly a security clip to prevent the removal of the louver panel from the assembly.

BRIEF DESCRIPTION OF THE PRIOR ART

Louver panel assemblies are, of course, well-known in the art. Perhaps the best known form of such louver panels are jalousies which have become popular home-building devices, especially in warmer climates. Typically, jalousies have a transparent louver panel, usually of glass, secured at each end to a stationary structure. The mounting brackets slip over each end of the glass louver panel and are pivotally attached to the stationary structure. An actuating rod interconnects the brackets such that the panels may be opened and closed simultaneously.

Although louver panels, such as jalousies, have achieved wide-spread acceptance, they often represent the weakest link in the security of the building in which they are utilized. The mounting brackets merely slide over the opposite ends of the glass jalousie panel and are prevented from disassembly from the panel by the side supporting structure which usually extends along the side of the panels. However, the mounting brackets are typically fabricated of relatively thin aluminum or relatively soft metal and the portions passing around the edges of the louver panel may be easily deformed. Thus, in order to gain access through a louver panel assembly, one need merely to deform the mounting brackets and slide the louver panel out of its mounting.

Many devices have been proposed over the years to increase the security of a louver panel and to prevent such undesired removal of the louver panel from its mounting brackets. One such device is a metallic strap that passes over the mounting bracket so as to completely surround the outer periphery of the bracket and the louver panel. The ends of the strap may be riveted together, or may have a screw-type clamping device to prevent unauthorized removal of the louver panel. Another security device involves a metallic strap which passes between a portion of the mounting bracket and the louver panel while another portion passes over the exterior surface of the mounting bracket. A separate clip may be utilized to retain the security device to the mounting bracket in order to prevent the end of the security clip from being deformed outwardly.

The aforementioned devices have failed to maximize the security of louver panel assemblies. The external strap-type which extends around the exterior of the mounting bracket is susceptible to being cut and deformed in the same manner as the mounting bracket in order to remove the louver panel. The portion of the security clips which are exterior of the mounting bracket may also be deformed in order to remove the louver panel.

SUMMARY OF THE INVENTION

The instant invention relates to a security clip for a louver panel which is entirely located between the louver panel and the mounting bracket such that it may not be cut or deformed to remove the louver panel from the mounting bracket. The security clip according to the invention comprises a flexible metal strap which extends substantially around the entire periphery of the louver panel between the mounting bracket and the panel. The security clip has a tab extending therefrom which engages a notch in the mounting bracket. The interengagement of the tab and the notch prevents the removal of the panel from the mounting bracket even though the mounting bracket may be deformed. Furthermore, since the security clip extends substantially around the entire periphery of the louver panel and mounts between the bracket and the panel, it is not susceptible to cutting or deforming. The ends of the security clip may interlock with each other, or may interlock with other portions of the clip in order to prevent deforming the security clip in order to remove the louver panel.

The invention also encompasses a louver panel assembly incorporating the security clip member.

BRIEF DESCRIPTION OF THE DRAWINGS

FIG. 1 is a side view, taken along line I—I in FIG. 2, showing a mounting bracket for a louver panel assembly.

FIG. 2 shows a plan view of the mounting bracket shown in FIG. 1.

FIG. 3 is a perspective view of a first embodiment of the security clip according to the invention.

FIG. 4 is a partial sectional view showing the security clip of FIG. 3 mounted between the louver panel and the mounting bracket.

FIG. 5 is a perspective view of a second embodiment of the security clip according to the invention.

FIG. 6 is a front view of a third embodiment of the security clip according to the invention, taken along line VI—VI in FIG. 7.

FIG. 7 is a side view of the third embodiment of the security clip shown in FIG. 6.

FIG. 8 is a perspective view of a fourth embodiment of the security clip according to the invention.

FIG. 9 is a cross-sectional view taken along line A—A in FIG. 3.

FIG. 10 is a cross-section view taken along line B—B in FIG. 5.

DETAILED DESCRIPTION OF THE PREFERRED EMBODIMENTS

Figure 11:
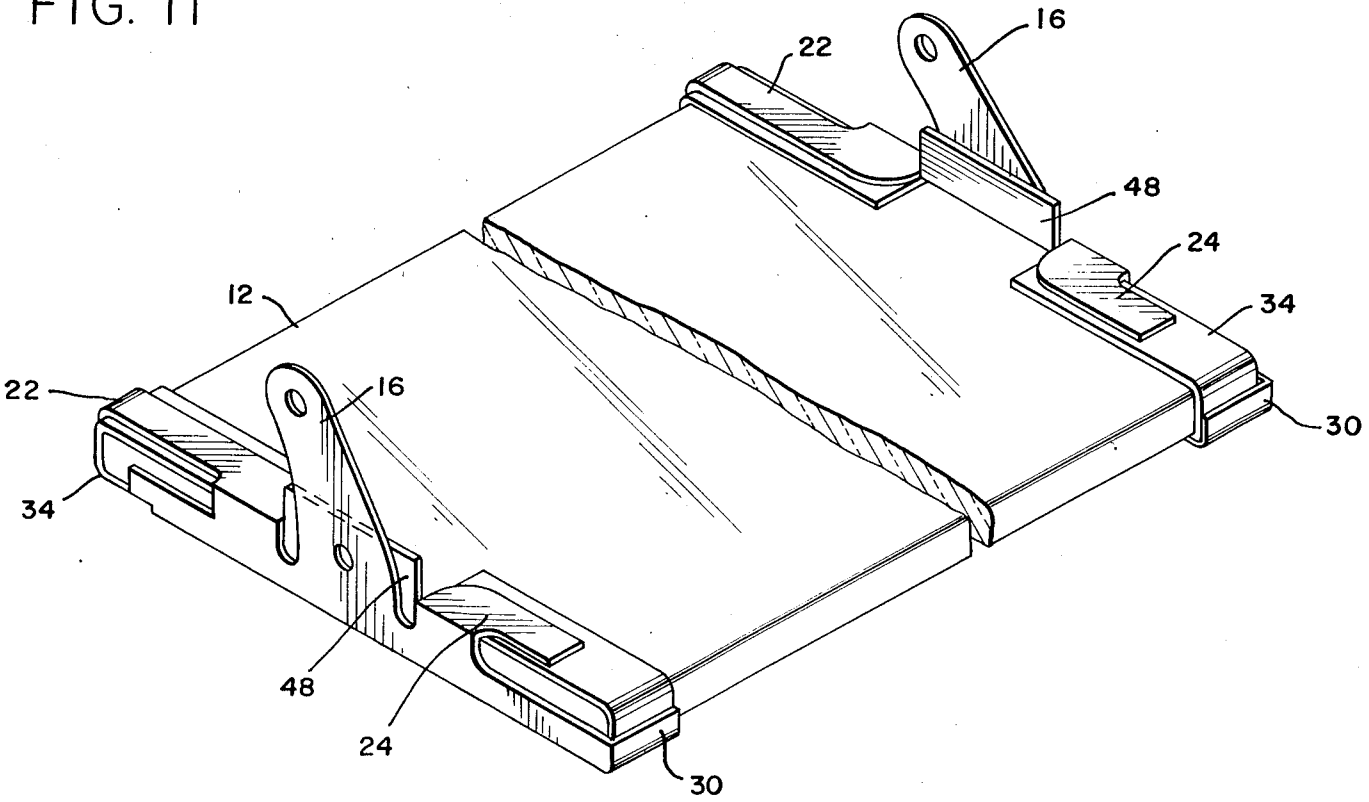

A typical mounting bracket for attaching a louver panel assembly to a supporting structure is shown in FIGS. 1 and 2. Mounting bracket 10 slides over each end of louver panel 12 and extends generally perpendicular to longitudinal axis 14 of the louver panel. Mounting bracket 10 has arm 16 extending therefrom, arm 16 defining a plurality of attachment holes 18 and 20. Pivoting attachment means extend through hole 18 and serve to pivotally attach the mounting brackets to a fixed, side support structure (not shown). Hole 20 is attached to an actuating rod (not shown) which is also attached to the remaining louver panel assemblies. Vertical movement of the actuating rod serves to pivot the individual panels about the support structure such that they may be simultaneously opened and closed. The mounting bracket 10 also has arms 22 and 24 extending generally parallel to the louver panel 12 along one side thereof. Arms 22 and 24 define a notch n between them as illustrated in FIG. 2. Arm 26 contacts the opposite side of louver panel 12.

The distal ends of arms 22 and 26 have downturned lip portions 28 and 30, respectively, which engage opposite edges of louver panel 12, as best seen in FIG. 1.

The lip portions 28 and 30, under normal circumstances, prevent the movement of louver panel 12 in a direction generally perpendicular to longitudinal axis 14, indicated by arrow 32 in FIG. 1, with respect to mounting bracket 10. However, the security of such a louver panel assembly may be easily compromised by deforming the end portion of either arm 22 or arm 26 to bend the lip portions 28 or 30 away from louver panel 12. When this occurs, the louver panel may be easily slipped from the mounting bracket 10 in the direction of arrow 32.

A security clip according to the invention is shown in FIGS. 3 and 4. The clip comprises a generally flat, elongated member 34 having a length sufficient to extend substantially around the periphery of the louver panel 12. The flat, elongated member 34 has first and second ends 36 and 38, the ends having tabs 40 and 42 extending therefrom. Elongated member 34 also defines recesses 44 and 46 located such that, when the member is placed around the louver panel 12, tabs 40 and 42 engage the recesses 44 and 46, respectively. Tab 48 extends from the elongated member 34 between the end portions 36 and 38.

As shown in FIG. 4, tab 48 extends upwardly through notch n defined between arms 22 and 24 of the mounting bracket 10. As also seen in FIG. 4, the elongated security clip member 34 extends substantially around the entire periphery of the louver panel 12 and, except for tab 48, is entirely contained between the louver panel and the arms 22, 24 and 26 of the mounting bracket. When the device is assembled, arms 22, 24 and 26 prevent the ends 36 and 38 of the elongated member 34 from moving in a direction generally perpendicular to the plane of the louver panel. This retains tabs 40 and 42 in engagement with recesses 44 and 46, respectively. This positive locking of the end 36 and 30 of the elongated member prevents their movement in the direction of arrow 50, shown in FIG. 4, generally parallel to the plane of the louver panel or the elongated member.

Thus, as seen in FIG. 4, even if both distal end portions 28 and 30 of arms 22 and 26 are bent away from the plane of the louver panel 12, the interengagement of tab 48 with the portion of arms 22 and 24 defining the notch n will prevent removal of the louver panel 12 from the mounting bracket 10 in a direction along arrow 50. The positive locking of end portions 36 and 38 also prevents the deformation of the security clip by pulling apart the end portions. The positive interlocking of the end portions, in conjunction with the tab 48 engaging the noth n positively prevents removal of the louver panel in either direction.

These features also enable the security clips to be produced from relatively thin material, thereby enabling its use in existing louver panel assemblies without requiring any modification of the mounting brackets. Tab 48 may initially be formed such that its distal end portion extends parallel to the end portions 36 and 38 as shown in dotted lines in FIG. 9. After assembly, the tab 48 may be deformed upwardly in the direction of arrow 51 such that it extends into notch n. This enables the security clip to be installed into the mounting hardware while it is attached to the louver panel.

FIG. 5 shows a second embodiment of the security clip. In this embodiment, elongated member **34*a* is of sufficient length so as to extend completely around the periphery of louver panel 12 and has means thereon to interlock the ends of the elongated member with each other. As can be seen, tabe 42*a* extends laterally from end 38*a* of elongated member 34*a* and engages recess 46*a* formed adjacent the opposite end 36*a* of the elongated member. Similarly, tab 40*a* extends laterally from end 36*a* and extends into recess 44*a* defined adjacent to end 38*a*. This positive interlocking of the ends prevents their separation in a direction extending generally parallel to the plane of louver panel 12. Tab 48*a* extends from elongated member 34*a* and serves the same function as tab 48 discussed in the previous embodiment. The distal end of tab 48*a* may initially extend generally parallel to the plane of the louver panel as shown in dotted lines in FIG. 10. After installation of the security clip between the mounting bracket and the louver panel, tab 48*a* may be bent in the direction of arrow 53** to extend upwardly through notch n.

When elongated member **34*a* is inserted between the mounting bracket 10 and the louver panel 12, tab 48*a* extends upwardly through notch n and prevents removal of the louver panel 12 from the mounting bracket 10 even if the ends of arms 22 and 26 are deformed. The ends 38*a* and 36*a* are disposed between the louver panel 12 and arm 26, thereby preventing their movement in a direction perpendicular to the plane of the louver panel 12**. Their positive interengagement also prevents any relative movement in a direction parallel to this plane.

FIGS. 6 and 7 show a third embodiment of the security clip. In this embodiment, elongated member **34*b* has tabs 40*b* and 42*b* extending from ends 36*b* and 38*b*, respectively. Tabs 40*b* and 42*b* extend upwardly through notch n defined by arms 22 and 24 of mounting bracket 10. This serves to prevent removal of the louver panel 12 from the mounting bracket 10 and at the same time prevents any movement of the ends 36*b* and 38*b* in a direction parallel to the plane of the louver panel. Tabs 52 extend inwardly from elongated member 34*b* so as to position the security clip on the end of the louver panel 12**.

A fourth embodiment of the security clip is shown in FIG. 8. Tabs **40*c* and 42*c* are formed on ends 36*c* and 38*c*, respectively, as in the previous embodiment. However, ends 36*c* and 38*c* contact each other and tabs 40*c* and 42*c* are arranged in a common plane to perform the function of tab 48 of the previous embodiments. As shown in FIG. 10, tabs 40*c* and 42*c* extend through notch n in mounting bracket 10 to lock the louver panel in the brackets. To facilitate assembly of the elements, the distal ends of tabs 40*c* and 42*c* may initially extend generally parallel to the plane of the louver panel. Recess 54** accommodates the distal ends of the tabs when in this position. After assembly, the distal ends may be bent upwardly to extend through notch n.

In each of the embodiments, tabs 48, 40 or 42 may be formed such that their distal ends extend generally parallel to the plane of louver panel 12. This allows the security clip to be installed into the mounting brackets while attached to the louver panel. After installation, the ends of the tabs may be bent upwardly such that the tabs extend into notch n as shown in FIGS. 4 and 7.

The foregoing description is provided for illustrative purposes only and should not be construed as in any way limiting this invention, the scope of which is defined solely by the appended claims.

What is claimed is:

1. A louver panel assembly comprising:

(a) a generally planar louver panel having a longitudinal axis;

(b) mounting brackets attached to end portions of the louver panel for attaching the panel to a structure, each bracket defining a notch;

(c) a security clip member attached to the louver panel such that it extends substantially around the periphery of the louver panel between the mounting bracket and the louver panel; and, (d) first tab means on the security clip engaging the notch so as to prevent removal of the louver panel from the mounting brackets in a direction generally perpendicular to the longitudinal axis.

2. A security clip for a louver panel having mounting brackets each defining a notch, the security clip comprising:

(a) a generally flat, elongated member of a length sufficient to extend substantially around the periphery of the louver panel between the louver panel and a mounting bracket, the elongated member having a side extending in a plane, and first and second ends; and, (b) first tab means entending from the elongated member in a direction generally perpendicular to the plane and adapted to engage the notch.

3. The security clip according to claim 2 further comprising means to lock the first and second ends so as to prevent their relative movement in a direction generally parallel to the plane.

4. The louver panel assembly according to claim 1 wherein the security clip member is a generally flat, elongated member having first and second ends extending substantially around the periphery of the louver panel in direct contact with the louver panel.

5. The louver panel assembly according to claim 4 wherein a distal end portion of the first tab means is deformable between a first position, wherein it extends generally parallel to the plane of the louver panel, and a second position wherein it extends generally perpendicular to the louver panel.

6. The louver panel assembly according to claim 4 further comprising means to lock the first and second ends of the elongated security clip member with a portion of the elongated member so as to prevent their movement in a direction generally perpendicular to the longitudinal axis of the louver panel.

7. The louver panel assembly according to claim 6 wherein the means to lock the first and second ends of the elongated security clip member comprises:

(a) first and second recesses defined by an edge of the elongated member and located on a first side of the louver panel; and, (b) second tab means extending from each of the first and second ends of the elongated member located on a second side of the louver panel extending around an edge of the louver panel so as to enter the first and second recesses, respectively.

8. The louver panel according to claim 6 wherein the length of the elongated security clip member is greater than the distance around the periphery of the louver panel and further comprising means to interlock the first and second ends together.

9. The louver panel according to claim 8 further comprising a recess defined by the elongated member adjacent each of the first and second ends and, second tab means formed on the first and second ends so as to engage the recesses defined by the elongated member.

10. The louver panel according to claim 9 wherein the recess adjacent the first end extends inwardly from a first edge of the elongated member and the recess adjacent the second end extends inwardly from a second edge of the elongated member.

11. The louver panel assembly according to claim 6 wherein the first tab means comprises first and second tab members extending from the first and second ends of the elongated member, respectively, each tab member extending generally perpendicular to the plane of the first and second ends.

12. The security clip according to claim 2 wherein a distal end portion of the first tab means is deformable between a first position, wherein it extends generally parallel to the plane containing a major portion of the elongated member, and a second position wherein it extends generally perpendicular to the plane.

13. The security clip according to claim 3 wherein the means to lock the first and second ends of the elongated member comprises:

(a) first and second recesses defined by an edge of the elongated member; and, (b) second tab means extending from each of the first and second ends of the elongated member adapted to extend around an edge of the louver panel and enter the first and second recesses, respectively.

14. The security clip according to claim 3 wherein the means to lock the first and second ends interlocks the first and second ends together.

15. The security clip according to claim 14 further comprising:

(a) a recess defined by the elongated member adjacent each of the first and second ends; and, (b) second tab means formed on the first and second ends adapted to engage the recesses defined by the elongated member.

16. The security clip according to claim 15 wherein the recess adjacent the first end extends inwardly from a first edge of the elongated member and the recess adjacent the second end extends inwardly from a second edge of the elongated member.

* * * * *